United States Patent [19]

Elson

[11] 4,239,461

[45] Dec. 16, 1980

[54] COMPRESSOR INDUCTION SYSTEM

[75] Inventor: John P. Elson, Sidney, Ohio

[73] Assignee: Copeland Corporation, Sidney, Ohio

[21] Appl. No.: 958,357

[22] Filed: Nov. 6, 1978

[51] Int. Cl.[3] ..... F04B 39/00

[52] U.S. Cl. ..... 417/312

[58] Field of Search ..... 417/312, 371, 902, 363; 181/403, 230, 264, 272, 269; 62/296

[56] References Cited

U.S. PATENT DOCUMENTS

| | | | |
|---|---|---|---|
| 1,388,554 | 8/1921 | Dubben et al. | 181/264 |
| 3,082,939 | 3/1963 | Warner | 417/363 |
| 3,101,891 | 8/1963 | Frank | 417/312 |
| 3,187,837 | 6/1965 | Beeching | 181/272 X |
| 3,396,908 | 8/1968 | Vind | 417/363 |
| 3,864,064 | 2/1975 | Gannaway | 417/312 |

*Primary Examiner*—Carlton R. Croyle
*Assistant Examiner*—Edward Look
*Attorney, Agent, or Firm*—Harness, Dickey & Pierce

[57] ABSTRACT

There is disclosed herein a refrigeration compressor having an induction system which includes a conduit for directing suction gas to the compressor and an associated muffler designed to attenuate noise generated by the suction process while still allowing relatively unrestricted flow through the conduit. In one form the conduit and associated suction muffler are integrally formed from a suitable plastic composition as a two piece assembly with the associated muffler being in the form of an elongated chamber overlying an opening in the conduit and arranged in longitudinally parallel relationship thereto.

21 Claims, 5 Drawing Figures

FIG. 1.
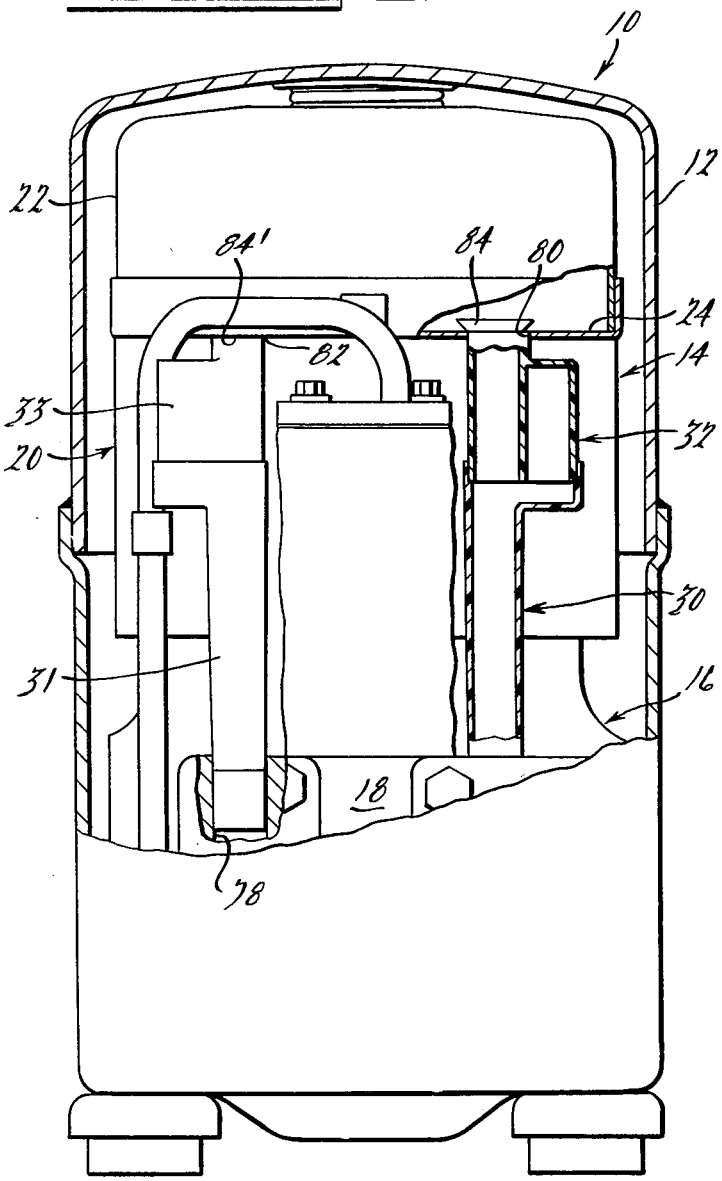
FIG. 2.
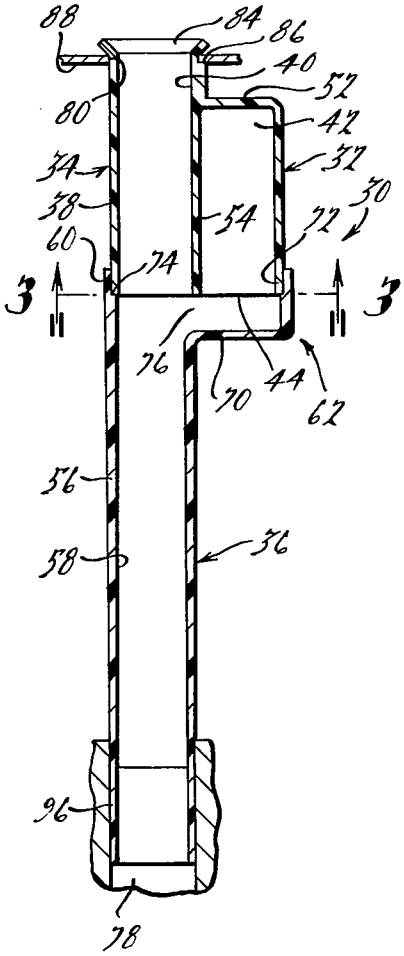
FIG. 3.
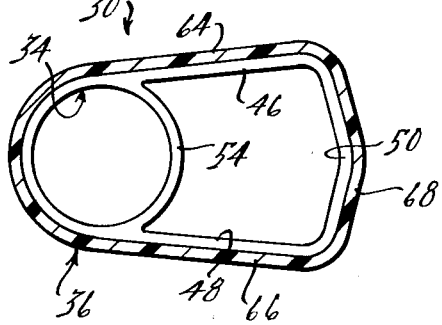
FIG. 4.
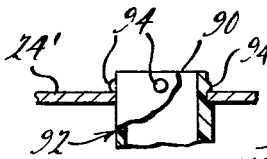
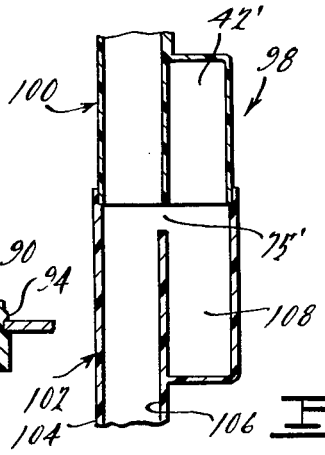
FIG. 5.

COMPRESSOR INDUCTION SYSTEM

BACKGROUND AND SUMMARY OF THE INVENTION

The present invention relates generally to induction systems for compressors and more particularly to such induction systems for refrigeration compressors which include noise attenuating means.

In design of high efficiency compressors it is important to provide relatively unrestricted suction gas flow to the compressor. However, this suction process results in the generation of substantial noise due both to the rapid flow of suction gas into the compressor as well as operation of the intake valving. Accordingly, it is desirable to provide some form of noise attenuating means in the suction gas flow path. However, it is also important to overall compressor efficiency to assure a relatively free unrestricted flow of suction gas to the compressor. Accordingly, the use of various forms of restrictors and baffles in the main flow path is undesirable in that such devices may create excessive flow losses requiring larger conduits be utilized to prevent compressor suction starvation.

As present practice requires the design of compressors to be as compact as possible, the available space within the assembly imposes several constraints on the size of suction mufflers. Further, because of these space limitations, it is often necessary to extend the suction gas conduit in close proximity to the discharge conduits. Accordingly, as the discharge gas is relatively hot due to the compression process, it is desirable to minimize heat transfer to the suction gas so as to maintain a high volumetric efficiency.

Accordingly, the present invention provides an induction system for a refrigeration compressor which includes a suction gas conduit assembly incorporating a suction muffler of the side branch resonator type which may be tuned to effectively attenuate any desired frequency noise generated by the suction process while still assuring a substantially unrestricted flow path for the suction gas. Preferably, the conduit assembly will be fabricated from a suitable plastic composition with the suction muffler integrally formed therewith in substantially axially parallel relationship so as to require only a minimal amount of space within the compressor. The use of a plastic composition not only enables fabrication of the conduit and associated sound attenuating means at relatively low cost but also minimizes the transfer of heat from the discharge gas to the suction gas thereby offering improved volumetric efficiency as well.

Additional advantages and features of the present invention will become apparent from the subsequent description and the appended claims taken in conjunction with the accompanying drawings.

BRIEF DESCRIPTION OF THE DRAWINGS

FIG. 1 is an elevational view of a refrigeration compressor in accordance with the present invention shown partially in section and having portions thereof broken away;

FIG. 2 is an enlarged sectioned view of the suction conduit assembly in accordance with the present invention and including the suction muffler, the section being taken along an axially extending radial plane;

FIG. 3 is an enlarged sectioned view of the suction conduit and associated muffler of FIG. 2, the section being taken along line 3—3 thereof;

FIG. 4 is a fragmentary view of the upper end portion of a suction conduit assembly in accordance with the present invention illustrating an alternative embodiment thereof; and FIG. 5 is a fragmentary sectioned view of another embodiment of a suction conduit assembly in accordance with the present invention, the suction being taken along an axially extending radial plane.

DESCRIPTION OF THE PREFERRED EMBODIMENT

Referring now to the drawings and in particular to FIG. 1, there is shown a hermetic refrigeration compressor indicated generally at 10 and comprising an outer shell 12 within which is resiliently mounted a motor compressor 14. Motor compressor 14 is of the reciprocating piston type and includes a lower compressor housing 16 having a cylinder head 18 secured to one side thereof and a motor assembly 20 secured to the upper end thereof and drivingly connected thereto. A shroud 22 is also provided which overlies and encloses the upper end of motor assembly 20 and includes a base portion 24 engaging the top surface of the motor stator core. A pair of substantially identical suction conduit assemblies 30 and 31, each of which has a suction muffler 32 and 33 respectively associated therewith, are also provided extending between base portion 24 of motor shroud 22 and compressor housing 16.

As best seen with reference to FIG. 2 and 3, suction conduit assembly 30 is of a two piece construction including an upper conduit member 34 and a lower conduit member 36. Upper conduit member 34 includes a cylindrical shaped tubular portion 38 having a bore 40 extending longitudinally therethrough and an integrally formed elongated chamber 42 open at the lower end 44 and defined by side walls 46, 48, and 50, an upper wall 52 and the outer wall portion 54 of tubular portion 38. Chamber 42 has a longitudinal axis disposed in substantially parallel relationship to the longitudinal axis of bore 40.

Lower conduit member 36 also has a cylindrically shaped elongated tubular portion 56 having a bore 58 extending longitudinally therethrough. Bore 58 has a diameter substantially equal to the diameter of bore 40 and is arranged coaxially therewith. Terminal end portion 60 of lower conduit member 36 is provided with an integrally formed offset portion 62 which includes side walls 64, 66, 68, and a lower radially extending end wall 70. Tubular portion 56 and offset portion 62 are of a size and shape so as to telescopically receive end portion 72 of upper conduit member 34. A peripherally extending step or flange 74 is provided extending around end portion 60 and side walls 64, 66, and 68 which operates to limit telescopic movement of upper conduit member 34 with respect to lower conduit member 36 so as to axially space end wall 70 of offset portion 62 from outer wall portion 54 thereby defining an opening 76 between bores 40 and 58 and chamber 42.

Thus, when upper and lower conduit members 34 and 36 are secured together, bores 40 and 58 thereof will define a substantially continuous unrestricted fluid passageway for conducting suction gas from motor shroud 22 to a suction gas passage 78 in compressor housing 16. Opening 76 enables fluid communication between chamber 42 and bores 40 and 58 thereby enabling chamber 42 to operate to attenuate noise generated by the suction process. Preferably and as seen in FIG. 3, opening 76 will extend circumferentially through approximately 180° and will have a length sufficient to provide a total area of communication between chamber 42 and bores 40 and 58 which is approximately equal to the cross sectional area of chamber 42. If desired, a plurality of separate openings concentrated in the area of opening 76 and having a total area substantially equal to the cross sectional area of chamber 42 may be provided in lieu of single opening 76. Also, the longitudinal length of chamber 42 will preferably be selected so as to be approximately equal to one-quarter of the wavelength of the fundamental noise frequency to be attenuated. The length of chamber 42 for any desired fundamental frequency may be easily calculated from the following formula:

$$\text{Length} = \frac{\text{Speed Of Sound Within Compressor}}{4 \times \text{Fundamental Frequency}}$$

It should be noted that increasing the volume of the chamber will result in increased attenuation at the center fundamental frequency as well as increased band width of attenuation; however, if the volume becomes too large, the center fundamental frequency tuning will be lost. It should also be noted that in order to achieve proper attenuation with minimal suction gas flow interference, chamber 42 must have an axial length greater than the width so as to insure resonance will occur in the longitudinal direction. As suction conduit assembly 31 is substantially identical to suction conduit assembly 30, further description thereof is omitted.

While suction conduit assembly 30 may be fabricated from any suitable material such as metal, preferably, both upper and lower conduit members 34 and 36 will be fabricated from a plastic composition such as by injection molding or any other suitable manner. While many types of plastic are well suited for this application, nylon or Valox are particularly well suited as they are highly resistant to degradation from the presence of refrigerant and lubricating oil as well as the temperatures encountered within the compressor. The use of a plastic composition is particularly desirable due to the low relative heat transfer capability of plastic as compared to metal. It is important to minimize the transfer of the heat of compression from the discharge gas to the suction gas in order to maintain a high volumetric efficiency within the compressor.

Referring once again to FIGS. 1 and 2, base portion 24 of shroud 22 is provided with a pair of spaced openings 80 and 82 into which the upper end portions 84 and 84' of suction conduit members 30 and 31 respectively are inserted. A shoulder 86 is provided on upper conduit member 34 adjacent the upper end 84 thereof which engages the lower surface 88 of base portion 24. In order to retain suction conduit assemblies 30 and 31 within respective openings 80 and 82, the inner end portions may be easily radially outwardly flared or suitably crimped.

Alternatively, as seen in FIG. 4, the end portion 90 of upper conduit member 92 may be provided with a plurality of radially outwardly extending protrusions 94 which may operate to provide a snap connection with base portion 24' should this be desired.

As best seen with reference to FIG. 2, tubular portion 56 of lower conduit member 36 is provided with a slight inner and outer draft (typically about 0° 15') extending approximately from end portion 60 which draft is necessary in order to facilitate removal from the mold during fabrication thereof. As this draft imparts a slightly decreasing outside diameter to tubular portion 56 from end portion 60 to just short of end 96 thereof, end portions 96 may be frictionally fitted and retained within suction passage 70 of compressor housing 16. This friction fit enables suction conduit assemblies 30 and 31 to easily accommodate any slight dimensional changes due to thermal expansion of the compressor components while still maintaining a relatively snug fit with passage 78. Additionally, as the plastic composition is slightly deformable relative to metal, end portion 96 is able to deform slightly to accommodate any out of roundness of passage 78 thereby insuring a relatively fluid tight engagement therebetween so as to prevent entry of lubricating fluid into the suction passage. Should it be desired, a suitable adhesive may be applied to end portion 96 so as to further insure a fluid tight seal within passage 78.

During the suction process, suction gas will be admitted into hermetically sealed shell 12 through a suitable opening (not shown) from which it will be drawn into the motor shroud 22 and flow across the end turns of the motor windings so as to cool the motor. From motor shroud 22, the suction gas will be drawn downwardly through suction conduit assemblies 30 and 31 into compressor housing passages 78 from which it will be drawn into the compression chambers. As the gas flows through suction conduit assemblies 30 and 31, noise generated by the relatively high velocity pulsating flow as well as valve noise will be effectively attenuated by the suction mufflers 32 and 33. It should be noted that while suction mufflers 32 and 33 may be positioned at any longitudinal position along suction conduits 30 and 31, it has been found that positioning mufflers 32 and 33 closer to the upper end has better performance. Further, as opening 76 into chamber 42 of the suction mufflers is disposed at the bottom of the chamber, oil or liquid refrigerant which may be entrained within the suction gas will not accumulate within the chambers. Further, the use of a plastic material for the suction conduit assemblies will operate to reduce heat transfer from the discharge gas thereby preserving the volumetric efficiency of the compressor. Also, as the plastic material is relatively flexible as compared to metal conduits, the end portion will readily deform slightly to accommodate any out of roundness of passage 96. This insures a tight fluid seal therebetween so as to prevent any intake of oil or the like which may cause slugging of the compressor. Also, the use of a plastic composition enables relatively inexpensive fabrication of an integral suction conduit and muffler assembly which can be molded in two pieces and easily assembled by means of a suitable adhesive.

Referring now to FIG. 5, another embodiment of a suction conduit assembly 98 is illustrated which is designed for half wavelength attenuation. Suction conduit assembly 98 includes an upper conduit member 100 and a lower conduit member 102. Upper conduit member 100 is substantially identical to upper conduit member 34 described above and therefore like portions have been indicated by like numerals primed. In this embodiment, lower conduit member 102 also includes a generally cylindrically shaped tubular portion 104 having a bore 106 extending therethrough and positioned in substantially coaxial relationship with bore 40' of upper conduit member 100. However, in this embodiment lower conduit member 102 is also provided with a chamber 108 of a size substantially identical to chamber 42' and arranged in longitudinal alignment therewith. As opening 75' is positioned midway along the length of combined chambers 42' and 108, these chambers will cooperate to provide one-half wavelength attenuation. The total length of chambers 42' and 108 may be easily calculated for any desired fundamental frequency attenuation by the following formula:

$$\text{Length} = \frac{\text{Speed Of Sound Within Compressor}}{2 \times \text{Fundamental Frequency}}$$

The operation and construction of suction conduit assembly 98 will otherwise be substantially identical to that of suction conduit assemblies 30 and 31 described above and hence further description thereof is omitted.

While it will be apparent that the preferred embodiments of the invention disclosed are well calculated to provide the advantages and features above stated, it will be appreciated that the invention is susceptible to modification, variation and changes without departing from the proper scope or fair meaning of the subjoined claims.

I claim:

1. A hermetic compressor comprising:

an outer shell;

compressor means mounted within said shell;

motor means secured to said compressor means; and elongated suction conduit means having one end secured to said compressor means, said suction conduit means defining a relatively unrestricted suction gas flow path therethrough for conducting suction gas from the interior of said shell to said compressor means, said suction conduit means including an elongated substantially closed noise attenuating chamber having a longitudinal axis disposed in substantially parallel offset relationship to the axis of said suction gas conduit, said chamber being positioned intermediate the ends of said conduit and an opening in said conduit for placing said chamber in communication with said suction gas flow path.

2. A hermetic compressor as set forth in claim 1 wherein said opening in said conduit has a surface area at least equal to approximately the cross sectional area of said chamber.

3. A hermetic compressor as set forth in claim 2 wherein said opening extends approximately 180° around the periphery of said flow path.

4. A hermetic compressor as set forth in claim 1 wherein said chamber has a length greater than the width thereof.

5. A hermetic compressor as set forth in claim 1 wherein said noise attenuating chamber has an axial length equal to one-quarter of the wavelength of a predetermined fundamental frequency to be attenuated and said opening is disposed at one end of said chamber.

6. A hermetic compressor as set forth in claim 5 wherein said noise attenuating chamber is positioned adjacent another end of said suction conduit means.

7. A hermetic compressor as set forth in claim 1 wherein said suction conduit assembly is fabricated from a plastic composition and comprises a first suction conduit member and a second suction conduit member secured in telescopic relationship.

8. In a hermetic compressor including an outer shell having a compressor mounted therein, motor means drivingly connected to said compressor, a motor shroud enclosing one end of said motor means, a suction gas conduit assembly comprising:

a suction gas conduit having one end secured within an opening provided in said shroud and the other end disposed within an opening provided in said compressor, said suction gas conduit defining a substantially unrestricted flow path for conducting suction gas from said shroud to said compressor;

an opening provided in a side wall of said suction gas conduit intermediate the ends thereof; and noise attenuating means overlying said opening, said noise attenuating means including an elongated closed chamber having a longitudinal axis disposed in substantially parallel offset relationship to the axis of said suction gas conduit, said chamber having an axial length greater than the width thereof and being positioned with said opening being immediately adjacent one end thereof.

9. A suction gas conduit assembly as set forth in claim 8 wherein said suction gas conduit assembly is fabricated from a plastic composition.

10. A suction gas conduit assembly as set forth in claim 9 wherein said suction gas conduit assembly includes an upper conduit member having an elongated bore extending therethrough and said noise attenuating means includes an upper chamber portion integrally formed with said upper conduit member.

11. A suction gas conduit assembly as set forth in claim 10 wherein said suction gas conduit further includes a lower conduit member having an elongated bore extending therethrough and said noise attenuating means includes a lower chamber portion integrally formed with said lower conduit member adjacent one end thereof, said upper and lower conduit members and chamber portions being secured in telescopic relationship.

12. A suction gas conduit assembly as set forth in claim 11 wherein the other end of said lower conduit member is tapered and is frictionally fitted within an opening provided in said compressor.

13. A suction gas conduit assembly as set forth in claim 11 wherein said opening is disposed in said lower conduit member.

14. A suction gas conduit assembly as set forth in claim 13 wherein said lower chamber portion is defined by axially extending side walls and a radially extending end wall, said opening being defined in part by said side walls and said end wall.

15. A suction gas conduit assembly as set forth in claim 14 wherein said lower conduit member and said lower chamber portion are provided with a peripheral stepped portion adjacent the upper end thereof, said stepped portion engaging the terminal end of said upper conduit member and upper chamber portion so as to limit inward telescopic movement therebetween.

16. A suction gas conduit assembly as set forth in claim 8 wherein said noise attenuating means is tuned for attenuating a predetermined fundamental frequency, said elongated chamber having an axial length equal to approximately one-quarter wavelength of said predetermined frequency.

17. A suction gas conduit assembly as set forth in claim 16 wherein said opening extends approximately one-half of the circumference of said suction gas conduit and has an axial length sufficient to provide a total area approximately equal to the transverse cross sectional area of said chamber.

18. A suction gas conduit assembly as set forth in claim 16 wherein said opening is disposed at the lower end of said chamber so as to prevent accumulation of liquid within said chamber.

19. In a hermetic compressor including an outer shell having a compressor mounted therein, motor means drivingly connected to said compressor, a motor shroud enclosing one end of said motor means, a suction gas conduit assembly comprising:

a suction gas conduit having one end secured within an opening provided in said shroud and the other end disposed within an opening provided in said compressor, said suction gas conduit defining a substantially unrestricted flow path for conducting suction gas from said shroud to said compressor;

an opening provided in a side wall of said suction gas conduit intermediate the ends thereof; and noise attenuating means overlying said opening, said noise attenuating means including an elongated closed chamber having a longitudinal axis disposed in substantially parallel offset relationship to the axis of said suction gas conduit, said chamber having an axial length greater than the width thereof and being positioned with said opening being approximately midway between opposite ends thereof.

20. A suction gas conduit assembly as set forth in claim 19 wherein said suction gas conduit assembly is fabricated from a plastic composition.

21. A suction gas conduit assembly as set forth in claim 19 wherein said noise attenuating means is tuned for attenuating a predetermined fundamental frequency and said elongated chamber has an axial length equal to one-half the wavelength of said fundamental frequency.

* * * * *